US007395654B2

(12) United States Patent
Takiue

(10) Patent No.: US 7,395,654 B2
(45) Date of Patent: Jul. 8, 2008

(54) REINFORCING COMPOSITE YARN AND PRODUCTION THEREFOR

(75) Inventor: Kotaro Takiue, Matsuyama (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 10/398,402

(22) PCT Filed: Aug. 1, 2002

(86) PCT No.: PCT/JP02/07871

§ 371 (c)(1),
(2), (4) Date: Apr. 7, 2003

(87) PCT Pub. No.: WO03/014446

PCT Pub. Date: Feb. 20, 2003

(65) Prior Publication Data

US 2004/0025486 A1 Feb. 12, 2004

(30) Foreign Application Priority Data

Aug. 7, 2001 (JP) ..... 2001-238934

(51) Int. Cl.
*D02G 3/02* (2006.01)
*D02G 3/22* (2006.01)

(52) U.S. Cl. ..... 57/210; 57/236

(58) Field of Classification Search ..... 57/200, 57/210, 227, 236, 238, 3; 28/100, 103, 271, 28/299; 428/364, 397
See application file for complete search history.

(56) References Cited

U.S. PATENT DOCUMENTS 3,365,872 A 1/1968 Field, Jr.
4,152,885 A 5/1979 Cox, Jr.
4,265,082 A * 5/1981 Sasaki et al. ..... 57/207
4,411,129 A * 10/1983 Parker et al. ..... 57/228
4,505,100 A * 3/1985 Yoshiyuki et al. ..... 57/207
5,497,608 A 3/1996 Matsumoto et al.
5,749,212 A * 5/1998 Rees et al. ..... 57/225

FOREIGN PATENT DOCUMENTS

| | | |
|---|---|---|
| GB | 2 021 660 A | 12/1979 |
| JP | 63-275736 | 11/1988 |
| JP | 1-61526 | 3/1989 |
| JP | 6-346332 | 12/1994 |
| JP | 2001-131842 | 5/2001 |

OTHER PUBLICATIONS

Kathryn L. Hatch, Textile Science, 1993 West Publishing Company, 1st edition, pp. 252-260, 302.*

* cited by examiner

*Primary Examiner*—Shaun R. Hurley
(74) *Attorney, Agent, or Firm*—Sughrue Mion, PLLC

(57) ABSTRACT

A composite yarn having a high reinforcing effect on a matrix material to be reinforced is a paralleled yarn of at least one substantially non-twisted multifilament yarn having a tensile strength of 13 cN/dtex or more and an initial modulus of 300 cN/dtex or more with at least one substantially non-twisted staple fiber yarn having a staple fiber fraction (1) having a fiber length of 1.5 times or more the average fiber length of the staple fibers and another fraction (2) having a fiber length of 0.5 time or less the average fiber length, in which a portion of the staple fibers in the staple fiber yarn winds around the periphery of the paralleled composite yarn to thereby bind the multifilament yarn and the staple fiber yarn substantially into a composite yarn without twisting the composite yarn.

16 Claims, 2 Drawing Sheets

REINFORCING COMPOSITE YARN AND PRODUCTION THEREFOR

TECHNICAL FIELD

The present invention relates to a reinforcing composite yarn and a process for producing the same. More particularly, the present invention relates to a reinforcing composite yarn which consists essentially of a substantially non-twisted composite yarn comprising a multifilament yarn having a high mechanical strength and a high modulus of elasticity and a staple fiber yarn comprising staple fibers different in fiber length from each other, in which staple fiber yarn, a portion of the staple fibers are present in the form of winding around the composite yarn periphery to bundle the composite yarn and a process for producing the composite yarn.

The reinforcing composite yarn of the present invention exhibit an excellent reinforcement effect on various matrix resins.

BACKGROUND ART

Functional fibers having high mechanical strength, high modulus of elasticity and a high heat resistance, for example, para-aromatic polyamide fibers, are widely employed as reinforcing materials for resin composites containing as a matrix, rubbers, epoxy resins or phenol resins, in industrial practice. These functional fibers are disadvantageous in that the bonding property to the matrix resins is low due to such a fact that the surfaces of the functional fibers exhibit a high smoothness, and the polymeric materials from which the functional fibers are formed exhibit a poor chemical activity, and thus the reinforcing effect of the functional fibers is not so high as expected from the high mechanical strength, for example, the high tensile strength, of the functional fibers.

It is known that spun yarns and stretch broken fiber yarns produced from the functional fibers have excellent bonding property to various types of matrix resins due to an anchor effect thereof provided from the fluffs present on or close to the peripheries of the yarns, and exhibit a good reinforcing effect on the matrix resins.

However, the spun yarns and stretch broken fiber yarns are formed from short length fibers produced by cutting or stretch breaking continuous filaments, and thus the resultant spun yarns and stretch broken fiber yarns exhibit a significantly lower mechanical strength, for example, tensile strength, than that expected from the mechanical strength of the original filaments. Therefore, the spun yarns and the stretch broken fiber yarns do not exhibit as high a reinforcing effect as that expected from the mechanical strength of the original filaments.

For the purpose of solving the above-mentioned problems of the conventional reinforcing yarns, a method in which functional groups for enhancing the bonding property to various types of the matrix resins are introduced into chemical structures of the polymers for forming the reinforcing fibers, and a method in which the stretch breaking length of the stretch broken fiber is increased to enhance the contribution of the mechanical strength of the original filaments on the mechanical strength of the resultant stretch broken fiber yarn, have been provided.

In the former method, however, the types of the functional groups to be introduced must be varied in response to the types of the matrix resins, and this necessity causes not only the productivity of the reinforcing yarns to be degraded but also the cost of the reinforcing yarns to be increased.

In the latter method, the contribution of the mechanical strength of the original filaments on the mechanical strength on that of the resultant stretch broken fiber yarn can be enhanced. However, as it is true that the fibers forming the yarn are short length fibers prepared by stretch breaking the continuous filaments, a reinforcing effect as high as that expected from the mechanical strength (tensile strength) of the original filaments cannot be realized.

Accordingly, a new type of reinforcing yarn in which the mechanical strength of a multifilament yarn is utilized with a high efficiency and the bonding effect to the matrix resins is satisfactory and the production cost is relatively low, is strongly desired.

SUMMARY OF THE INVENTION

An object of the present invention is to provide a reinforcing composite yarn in which a high mechanical strength of a multifilament yarn is utilized with a high efficiency, and which exhibits a satisfactory bonding effect on various matrix resins and thus can realize an excellent reinforcing effect on the matrix resins, and a process for producing the same.

The reinforcing composite yarn of the present invention consists essentially of a substantially non-twisted composite yarn comprising at least one substantially non-twisted multifilament yarn comprising a plurality of continuous filaments and paralleled with at least one substantially non-twisted staple fiber yarn comprising a plurality of staple fibers, wherein

- the multifilament yarn exhibits a tensile strength of 13 cN/dtex or more and an initial modulus of 300 cN/dtex or more;
- the staple fiber yarn comprises a staple fiber fraction having a fiber length of 1.5 times or more the average fiber length of the staple fiber yarn and another staple fiber fraction having a fiber length of 0.5 times or less the average fiber length of the staple fiber yarn, each in a content of at least 15% by mass; and
- a portion of the staple fibers in the staple fiber yarn is present in the form of winding around the periphery of the paralleled composite yarns, to thereby bind the multifilament yarn with the staple fiber yarns into a composite yarn.

In the reinforcing composite yarn of the present invention, the staple fibers in the staple fiber yarn preferably have a individual fiber thickness of 5.5 dtex or less.

The reinforcing composite yarn of the present invention preferably has a tensile strength of 11.5 cN/dtex or more.

In the reinforcing composite yarn of the present invention, the multifilament yarn preferably has a thickness in the range corresponding to 10 to 90% of the total thickness of the composite yarn.

In the reinforcing composite yarn of the present invention, the continuous filaments in the multifilament yarn preferably have an individual filament thickness of 0.1 to 22 dtex.

In the reinforcing composite yarn of the present invention, the continuous filaments in the multifilament yarn are preferably selected from poly-paraphenylene terephthalamide filaments, copolyparaphenylene-3,4'-oxydiphenyleneterephthalamide filaments, polyparaphenylene benzooxazole filaments, high strength polyethylene filaments, high strength polyvinyl alcohol filaments, wholly aromatic polyester filaments and carbon filaments.

In the reinforcing composite yarn of the present invention, the staple fibers in the staple fiber yarn preferably have an average fiber length in the range of 35 to 150 cm.

In the reinforcing composite yarn of the present invention, the staple fibers in the staple fiber yarn are preferably selected from nylon 6 staple fibers, nylon 66 staple fibers, meta-aromatic polyamide staple fibers, and para-aromatic polyamide staple fibers.

In the reinforcing composite yarn of the present invention, a major portion of the individual continuous filaments is preferably distributed in a core section of the composite yarn.

In the reinforcing composite yarn of the present invention, preferably, at least a portion of the individual continuous filaments and at least a portion of the individual staple fibers are intertwined with each other.

The process of the present invention for producing a reinforcing composite yarn comprises:

paralleling at least one substantially non-twisted multifilament yarn comprising a plurality of continuous filaments and at least one substantially non-twisted staple fiber yarn comprising a plurality of staple fibers, the multifilament yarn having a tensile strength of 13 cN/dtex or more and an initial modulus of 300 cN/dtex or more, and the staple fiber yarn containing at least 15% by mass of a staple fiber fraction having a fiber length of 1.5 times or more the average fiber length of the staple fiber yarn and at least 15% by mass of another staple fiber fraction having a fiber length of 0.5 times or less the average fiber length of the staple fiber yarn without twisting the paralleled yarns together; and passing the non-twisted paralleled composite yarn through an air eddy swirling along a plane intersecting the longitudinal axis direction of the paralleled composite yarn, to thereby cause a portion of the staple fibers in the paralleled composite yarn to be wound around the periphery of the paralleled composite yarn to thereby bind the paralleled composite yarn.

In the process of the present invention for producing a reinforcing composite yarn, the staple fibers in the staple fiber yarn preferably have an individual fiber thickness of 5.5 dtex or less.

In the process of the present invention for producing a reinforcing composite yarn, the composite yarn preferably has a tensile strength of 11.5 cN/dtex or more.

In the process of the present invention for producing a reinforcing composite yarn, the multifilament yarn preferably has a thickness in the range corresponding to 10 to 90% of the total thickness of the composite yarn.

In the process of the present invention for producing a reinforcing composite yarn, the continuous filaments in the multifilament yarn preferably have an individual filament thickness of 0.1 to 22 dtex.

In the process of the present invention for producing a reinforcing composite yarn, the continuous filaments in the multifilament yarn are preferably selected from poly-paraphenylene terephthalamide filaments, copolyparaphenylene-3,4'-oxydiphenyleneterephthalamide filaments, polyparaphenylene benzooxazole filaments, high strength polyethylene filaments, high strength polyvinyl alcohol filaments, wholly aromatic polyester filaments and carbon filaments.

In the process of the present invention for producing a reinforcing composite yarn, the staple fibers in the staple fiber yarn preferably have an average fiber length in the range of 35 to 150 cm.

In the process of the present invention for producing a reinforcing composite yarn, the staple fibers in the staple fiber yarn are preferably selected from nylon 6 staple fibers, nylon 66 staple fibers, meta-aromatic polyamide staple fibers, and para-aromatic polyamide staple fibers.

In the process of the present invention for producing a reinforcing composite yarn, the air eddy swirling procedure preferably causes a major portion of the individual continuous filaments to be distributed in a core section of the composite yarn.

In the process of the present invention for producing a reinforcing composite yarn, the air eddy swirling procedure preferably causes at least a portion of the individual continuous filaments and at least a portion of the individual staple fibers to be intertwined with each other.

BEST MODE FOR CARRYING OUT THE INVENTION

The reinforcing composite yarn of the present invention is a paralleled composite yarn of at least one multifilament yarn comprising a plurality of continuous filaments with at least one staple fiber yarn comprising a plurality of staple fibers. The multifilament yarn and the staple fiber yarn are respectively substantially not twisted, and, the resultant paralleled composite yarn is substantially not twisted.

In the reinforcing composite yarn of the present invention, the multifilament yarn has a tensile strength of 13 cN/dtex or more, and an initial modulus of 300 cN/dtex or more, and the staple fiber yarn comprises staple fiber fractions different in fiber length from each other, wherein a staple fiber fraction (1) having a fiber length of 1.5 times the average fiber length of the staple fibers in the staple fiber yarn and another staple fiber fraction (2) having a fiber length of 0.5 times or less the average fiber length as mentioned above are contained in a content of at least 15% by mass based on the total mass of the staple fiber yarn, respectively.

Further, in the reinforcing composite yarn of the present invention, it is important that a portion of the staple fibers in the staple fiber yarn is present in the form of winding up around the periphery of the paralleled composite yarn, to thereby bind the paralleled multifilament yarn and staple fiber yarn into a composite yarn.

Figure 1:
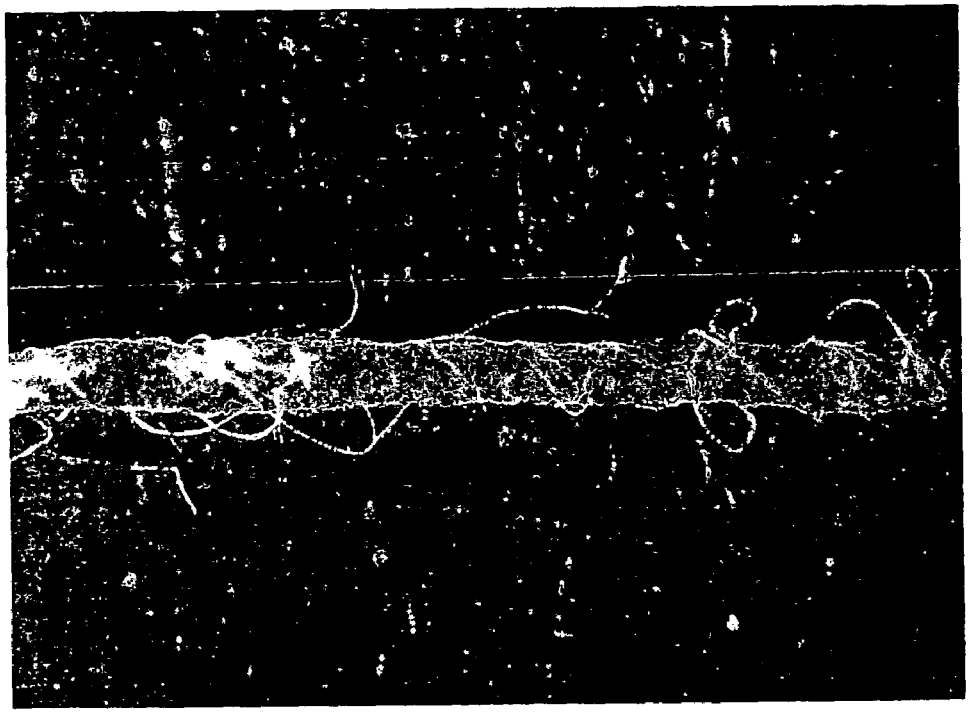
FIG. 1 is a photograph showing a side view of an embodiment of the reinforcing composite yarn of the present invention.

Referring to FIG. 1, namely the photograph showing a side view of an embodiment of the reinforcing composite yarn of the present invention, in a composite yarn comprising a multifilament yarn and a staple fiber yarn paralleled with each other, a portion of the staple fibers are wound in the form of coils around the periphery of the composite yarn to bind the multifilament yarn and the staple fiber yarn into a composite yarn.

Figure 2:
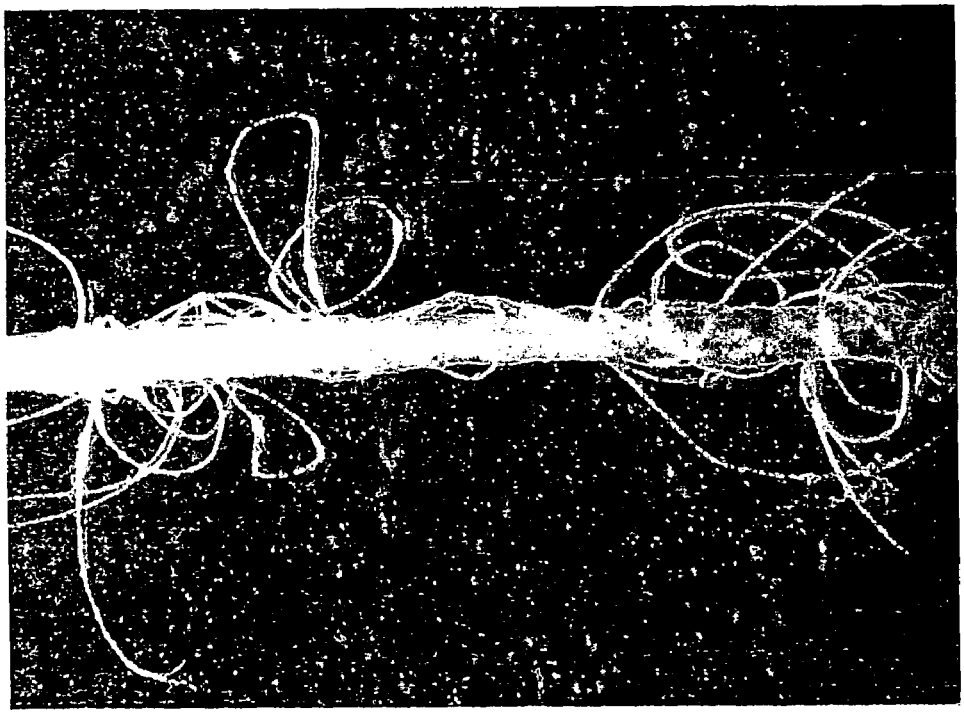
FIG. 2 is a photograph showing a side view of another embodiment of the reinforcing composite yarn of the present invention.

Referring to FIG. 2, namely the photograph showing a side view of another embodiment of the reinforcing composite yarn of the present invention, a portion of the staple fibers is wound around the periphery of the composite yarn comprising a multifilament yarn and a staple fiber yarn paralleled with each other to bind the two yarns with each other, and a portion of the winding staple fibers extends outward from the periphery of the composite yarn, and thus the resultant composite yarn is provided with an appearance of a bulky yarn.

The process of the present invention for producing the reinforcing composite yarn comprises the steps of paralleling at least one multifilament yarn comprising a plurality of continuous filaments, substantially non-twisted, and having a tensile strength of 13 cN/dtex or more and an initial modulus of 30 cN/dtex or more and at least one staple fiber yarn comprising a plurality of staple fibers, substantially non-twisted and having a staple fiber fraction having a fiber length of 1.5 times or more the average fiber length of the staple fibers in the staple fiber yarn and another staple fiber fraction having a fiber length of 0.5 times or less the average fiber length as mentioned above, each in a content of at least 15% by mass, without twisting the paralleled yarns together.

The non-twisted, paralleled composite yarn passes through an air eddy swirling along a plane intersecting the longitudinal axis direction of the paralleled composite yarn, to thereby cause a portion of the staple fibers in the composite yarn to wind around the periphery of the paralleled composite yarn to thereby bind the composite yarn.

Figure 3:
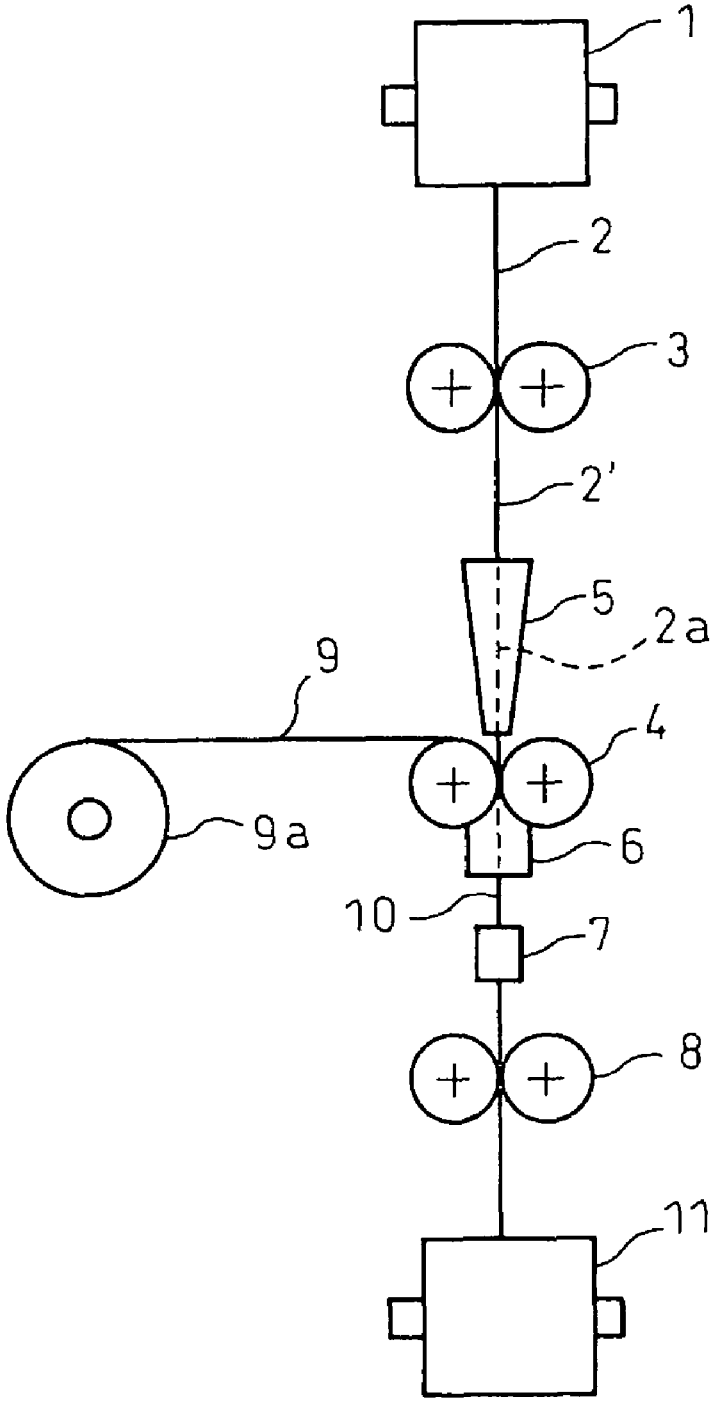
FIG. 3 is a flow sheet showing an embodiment of the process of the present invention for producing a reinforcing composite yarn.

The process of the present invention can be carried out by the apparatus as shown, for example, in FIG. 3.

In FIG. 3, a drawn, non-twisted multifilament yarn 2 is fed from a bobbin 1, into a stretch breaking machine comprising a pair of feeding roller 3 and a pair of stretch breaking rollers 4 spaced, for example, 1000 mm, from the feeding rollers 3 and rotating at a peripheral speed more than the feeding speed of the feeding rollers 3; the individual filaments in the fed yarn 2' through the feeding rollers 3 stretch-broken in a trumpet-shaped shredder 5 arranged between the feeding rollers 3 are and the stretch breaking rollers 4, to provide a bundle 2*a* of non-twisted stretch-broken staple fibers having uneven fiber lengths. At this stage, separately, another drawn, non-twisted multifilament yarn 9 is unwound from the bobbine 9*a* and fed into the stretch breaking rollers 4 to parallel the multifilament yarn 9 with the bundle 2*a* of the non-twisted, stretch broken staple fibers to provide a composite yarn, the resultant paralleled composite yarn 10 is taken-out from the stretch-breaking roller 4 by a suction air stream created by an aspirator 6 arranged in the output side of the stretch-breaking roller 4. The taken-out composite yarn 10 is passed through a false twisting air nozzle 7. In the false twisting air nozzle 7, the paralleled, non-twisted composite yarn is treated with an air eddy stream swirling around the paralleled non-twisted composite yarn, to cause a portion of the staple yarns in the paralleled, non-twisted composite yarn to be wound around the periphery of the composite yarn, to thereby combine the multifilament yarn and the staple fiber yarn into a composite yarn. In this air eddy treatment, by controlling the tension or relaxation applied to the composite yarn, and/or the speed of the air eddy stream, it is possible to cause the portion of the staple fiber to wind around the periphery of the composite yarn and to bind the multifilament yarn and the staple fiber yarn into a composite yarn and, further, parts of the winding staple fibers around the composite yarn to extend outward so as to impart a bulky yarn-like appearance to the resultant composite yarn, and/or a portion of the individual staple fibers and a portion of the individual filaments to be intertwined with each other.

The staple fiber-winding composite yarn is withdrawn from the false twisting air nozzle 7 by a pair of tensing rollers 8 and wound around a taking up bobbine 11.

In the paralleled composite yarn of the non-twisted staple fiber yarn with the non-twisted multifilament yarn, the multifilament yarn may form a core section of the composite yarn and the staple fiber yarn may be arranged so as to surround the multifilament yarn core section. In this case, the structure of the composite yarn wound by the staple fibers is made tight and the resultant composite yarn exhibits enhanced tensile strength and initial modulus.

Also, where at least a portion of the individual filaments and at least a portion of the individual staple fibers in the composite yarn are intertwined with each other, the occurrence of slippage between the individual filaments and the individual staple fibers in the composite yarn is prevented and the resultant composite yarn exhibits an enhanced reinforcing effect.

The parts of the staple fibers winding around and extending outward from the periphery of the composite yarn, exhibit an anchoring effect due to which the bonding strength of the composite yarn is enhanced, when the composite yarn is bonded.

The portion of the staple fibers other than the portion of the staple fibers winding around the composite yarn to combine the composite yarn and optionally extending outward from the composite yarn must be substantially not twisted. If it is twisted, there is a trend of decreasing the mechanical strength of the resultant composite yarn. Further, if the composite yarn is not wound and combined by the portion of the staple fibers, even when a portion of the staple fibers and a portion of the filaments are intertwined with each other, the staple fibers are easily slipped off and slippages between the filaments and staple fibers easily occur. Thus the resultant composite yarn cannot exhibit a satisfactory reinforcing effect.

In the reinforcing composite yarn of the present invention, the multifilament yarn contained therein must have a tensile strength of 13 cN/dtex or more, preferably 17.5 cN/dtex or more, more preferably 26.5 cN/dtex or more, to exhibit a sufficient reinforcing effect as a reinforcing material for various matrix resins. If the tensile strength of the multifilament yarn is less than 13 cN/dtex, the resultant composite yarn has an unsatisfactory tensile strength at breakage and exhibits an insufficient reinforcing effect and thus the mechanical strength-increasing effect of the composite yarn on the resultant composite materials of the composite yarn with various types of matrix resins is insufficient.

There is no upper limit to the tensile strength of the multifilament yarn, and the higher the tensile strength, the more preferable the resultant multifilament yarn. However, when the tensile strength is too high, the resultant multifilament yarn may exhibit too low a ultimate elongation and thus the resultant composite yarn may exhibit an unsatisfactory reinforcing effect when used as a reinforcing material. Alternatively, the resultant multifilament yarn may exhibit too high a fibrillating property and thus the resultant composite yarn may have a poor durability in practical use. Further alternatively, the resultant multifilament yarn is too costly and thus is economically disadvantageous. Accordingly, the tensile strength of the multifilament yarn is preferably not more than 50 cN/dtex, more preferably not more than 40 cN/dtex.

The multifilament yarn usable for the composite yarn of the present invention must have an initial modulus of 300 cN/dtex or more, preferably 400 cN/dtex or more, more preferably 500 cN/dtex or more. The above-mentioned initial modulus enables the resultant composite products reinforced with the composite yarn of the present invention to exhibit satisfactory rigidity and dimensional stability. If the initial modulus is less than 300 cN/dtex, the resultant composite yarn exhibits an insufficient reinforcing effect, and the resultant composite products reinforced by the composite yarn exhibits unsatisfactory rigidity and an insufficient dimensional stability.

There is no specific limitation to the individual filament thickness of the continuous filaments from which the multifilament yarn is constituted. However, if the thickness is too high or too low, the multifilament yarn having the above-mentioned tensile strength and the initial modulus may be difficult to produce, the stability of the procedures for producing the composite yarn may decrease, and the resultant composite yarn may exhibit a poor handling property. Generally, the thickness of the individual filaments of the multifilament yarn is preferably in the range of from 0.1 to 22 dtex.

There is no necessity to specifically limit the type of the polymer from which the filaments for the composite yarn of the present invention are formed, and any type of filaments may be employed, as long as the resultant multifilament yarn satisfies the above-mentioned requirements. The filaments for the multifilament yarn include, for example, poly-paraphenylene terephthalamide filaments, copolyparaphenylene-3,4'-oxydiphenyleneterephthalamide filaments, polyparaphenylene benzooxazole filaments, high strength polyethylene filaments, high strength polyvinyl alcohol filaments, wholly aromatic polyester filaments and carbon filaments.

The staple fibers usable for constituting the staple fiber yarn for the composite yarn of the present invention are uneven in the fiber length. When the staple fiber has an average fiber length represented by L, the staple fiber yarn comprises a staple fiber fraction (1) having a fiber length of 1.5L or more another staple fiber fraction (2) having a fiber length of 0.5L or less, both the fractions (1) and (2) are present in a content of 15% by mass or more, preferably 15 to 20%. If the content of the staple fiber fraction (1) having a fiber length of 1.5L or more is less than 15% by mass, the resultant composite yarn exhibits an insufficient mechanical strength. Also, if the content of the staple fiber fraction (2) having a fiber length of 0.5L or less is less than 15% by mass, the staple fibers exhibit insufficient fluffing around the periphery of the composite yarn and thus cannot exhibits a sufficient anchoring effect. Thus, the resultant composite yarn cannot exhibit a sufficient reinforcing effect.

When the average fiber length of the staple fibers is too short, the resultant composite yarn may exhibit a low mechanical strength. Also, if the average fiber length is too long, it may cause the amount of the fluffs formed around the resultant composite yarn to decrease and the reinforcing effect of the composite yarn to decrease. Generally, the average fiber length of the staple fibers is preferably in the range of from 35 to 150 cm.

When the individual fiber thickness of the staple fibers is too large, the number of fluffs formed around the periphery of the resultant composite yarn becomes small, and the resultant staple fibers exhibit a high rigidity, and are difficult to intertwine with the continuous filaments in the composite yarn and to wind around the periphery of the composite yarn to combine it, and easily slip off from the composite yarn. Thus, when the resultant composite yarns are dispersed and embedded in a matrix resin, the anchoring effect of the fluffs on the composite yarns is poor and thus the reinforcing effect of the composite yarns is insufficient. Accordingly, the individual fiber thickness of the staple fibers is preferably 5.5 dtex or less, more preferably 1.5 dtex or less, still more preferably 0.8 dtex or less, however, when the individual fiber thickness is too low, the production of the thin staple fibers becomes difficult. Therefore, the individual fiber thickness is preferably not less than 0.1 dtex.

There is no limitation to the type of polymer from which the staple fibers usable for the composite yarn of the present invention are formed, and the polymer may be selected from conventional polymers, as long as the resultant staple fibers satisfy the above-mentioned requirements. The polymer for the staple fibers may be the same as or different from the polymer for the filaments. Accordingly, the staple fibers usable for the present invention may be selected in response to the properties required to the resultant composite yarn, for example, from nylon 6 staple fibers, nylon 66 staple fibers, meta-aromatic polyamide staple fibers, and para-aromatic polyamide staple fibers.

When the staple fibers are selected from those having a high bonding property for the matrix resins, for example, thermo-plastic resins, thermosetting resins and rubbers. For example, for use in reinforcing rubber materials, nylon 6 or nylon 66 staple fibers can significantly enhance the reinforcing effect of the resultant composite yarn.

Also, for the use in which a reinforcing material having a high heat resistance is required, flame retardant staple fibers, for example, meta aromatic polyamide staple fibers, are advantageously employed. Further, for the use in which a reinforcing composite yarn having high mechanical strength and rigidity is required, the high strength, high modulus staple fibers, for example, para aromatic polyamide staple fibers of the same type as the filaments of the multifilament yarn, are advantageously employed.

In the composite yarn of the present invention, the mixing proportions, in yarn thickness, of the multifilament yarn and the staple fiber yarn are calculated on the basis of the total thickness of the composite yarn. Preferably, the proportion of the multifilament yarn is in the range of from 10 to 90%, more preferably from 40 to 60%. When the proportion of the multifilament yarn is too low, the resultant composite yarn may have an insufficient mechanical strength and thus may exhibit an unsatisfactory reinforcing effect. When the proportion of the multifilament yarn is too high, the anchoring effect of the staple fibers on the composite yarn may be insufficient and thus the resultant composite yarn may have an insufficient bonding property to the matrix resin and may exhibit an unsatisfactory reinforcing effect.

In the composite yarn of the present invention, preferably, the filaments of the multifilament yarn are located in the core section of the composite yarn and the staple fibers of the staple fiber yarns are located around the core section formed from the filaments to form a sheath section of the composite yarn. In this case, a portion of the filaments and a portion of the staple fibers may be intertwined with each other in the interface portion between the core section and the sheath section. The intertwinement restricts the slippage between the filaments and the staple fibers to enhance the reinforcing effect of the composite yarn. If the filaments are located in the sheath section rather than the core section, the amount of the fluffs which significantly contribute to enhancing the bonding property of the composite yarn to the matrix material decreases, and thus not only may the anchoring effect of the staple fibers on the composite yarn decrease, but also the resultant composite yarn may exhibit insufficient tensile strength and initial modulus. Also, the winding and combining effect of the staple fibers on the composite yarn becomes insufficient.

EXAMPLES

The reinforcing composite yarn and the process for producing the same of the present invention will be further illustrated by the following examples.

Examples 1 to 3

In each of Examples 1 to 3, a yarn prepared by paralleling four aromatic copolymeric polyamide multifilament yarns each prepared from 25 molar % of a paraphenylenediamine component, 25 molar % of a 3,4'-diaminodiphenylether component and 50 molar % of a terephathalic acid component (trademark: TECHNORA, made by TEIJIN LTD., and each having a tensile strength of 24.7 cN/dtex, an initial modulus of 520 cN/dtex, an ultimate elongation of 4.6% and a yarn count of 440 dtex/267 filaments) was fed to the apparatus shown in FIG. 1, the individual filaments in the multifilament yarn were stretch broken at a stretch ratio as shown in Table 1, the resultant stretch broken fiber yarn (staple fiber yarn) was paralleled with the same aromatic copolymerized polyamide multifilament yarn (440 dtex/267 filaments) as mentioned above by the apparatus of FIG. 1, to provide a paralleled precursory composite yarn. At the outlet of the stretch breaking rollers 4, the resultant fleece had an average staple fiber length L and comprised a staple fiber fraction (1) having a staple fiber length of 1.5L or more and another staple fiber fraction (2) having a staple fiber length of 0.5L or less, each in the content as shown in Table 1. After the paralleled precursory composite yarn passed through the false twisting air nozzle 7, the filaments of the multifilament yarn are mainly located in a core section of the resultant composite yarn. A portion of the filaments and a portion of the staple fibers in the composite yarn are intertwined with each other and a portion of the staple fibers are wound around the periphery of the composite yarn to firmly bind the composite yarn. Thus the fluffs formed around the periphery of the composite yarn from the winding staple fibers did not slip off from the composite yarn during practical use. Table 1 shows the thickness, tensile strength, ultimate elongation and initial modulus of the composite yarn, the proportion in thickness of the multifilament yarn based on the total thickness of the composite yarn, and a tensile strength contribution, which refers to a proportion of the tensile strength of the resultant composite yarn based on the tensile strength of the original multifilament yarn before being combined with the staple fiber yarn, in accordance with the present invention.

changed as shown in Table 1 and, as a multifilament yarn to be paralleled with the stretch broken staple fiber yarn, an aromatic copolymeric polyamide multifilament yarn (trademark: TECHNORA, made by TEIJIN LTD, and having a tensile strength of 24.7 cN/dtex, an initial modulus of 520 cN/dtex, an ultimate elongation of 4.6% and a yarn count of 220 dtex/133 filaments), was employed.

The results are shown in Table 1.

Comparative Example 1

The same stretch breaking and pneumatic false twisting procedures as in Example 1 were carried out, except that the multifilament yarn supplied to the stretch breaking procedure was prepared from 8 polyamide multifilament yarns by paralleling them with each other, and the stretch broken staple fiber yarn was not paralleled with the aromatic polyamide multifilament yarn. A stretch broken aromatic copolymeric polyamide staple fiber yarn was obtained. The stretch broken staple fiber yarn was subjected to the same tests as in Example 1. The test results are shown in Table 1.

Comparative Example 2

A composite yarn was produced by the same procedures as in Example 1, except that in place of the multifilament yarn to be paralleled with the stretch broken staple fiber yarn, a sliver having a thickness of 440 dtex and comprising aromatic copolymeric polyamide staple fibers having a fiber length of 51 mm was employed. The resultant aromatic copolymeric polyamide composite yarn was subjected to the same tests as in Example 1. The test results are shown in Table 1.

TABLE 1

| | Example No | | | | | | |
|---|---|---|---|---|---|---|---|
| | Example | | | | | Comparative Example | |
| Item | 1 | 2 | 3 | 4 | 5 | 1 | 2 |
| Stretch ratio in stretch breaking | 4.0 | 6.2 | 14.5 | 7.2 | 14.2 | 4.0 | — |
| Properties of staple fiber yarn Average fiber length L (mm) | 504 | 504 | 504 | 504 | 504 | 504 | 51 |
| Proportion of staple fiber fraction (1) $(*)_1$ (%) | 15.2 | 15.6 | 16.6 | 15.6 | 15.9 | 15.3 | 0 |
| Proportion of staple fiber fraction (2) $(*)_2$ (%) | 15.7 | 16.2 | 16.8 | 16.0 | 16.3 | 15.7 | 0 |
| Average individual staple fiber thickness (dtex) | 1.65 | 1.65 | 1.65 | 1.65 | 1.65 | 1.65 | 1.65 |
| Content in thickness of multifilament yarn in composite yarn (%) | 52 | 62 | 79 | 49 | 65 | 0 | 52 |
| Properties of composite yarn Thickness (dtex) | 843 | 709 | 555 | 450 | 337 | 862 | 872 |
| Tensile strength (cN/dtex) | 21.5 | 20.9 | 21.0 | 20.7 | 20.8 | 17.9 | 12.8 |
| Initial modulus (cN/dtex) | 487 | 474 | 464 | 432 | 463 | 375 | 268 |
| Ultimate elongation (%) | 4.3 | 4.1 | 4.1 | 4.1 | 4.0 | 4.2 | 4.9 |
| Contribution on strength $(*)_3$ (%) | 87 | 85 | 85 | 84 | 84 | 72 | 52 |

[Note]
$(*)_1$ Proportion in mass of staple fiber fraction (1) having a fiber length of 1.5 L or more, in staple fiber yarn
$(*)_2$ Proportion in mass of staple fiber fraction (2) having a fiber length of 0.5 L or less, in staple fiber yarn
$(*)_3$ Percentage of the tensile strength of the composite yarn based on the tensile strength of multifilament yarn before combined with staple fiber yarn

Examples 4 and 5

In each of Examples 4 and 5, a composite yarn was produced by the same procedures as in Example 1, except that the stretching ratio in the stretch breaking procedure was Then, each of the composite yarns of Example 1 and Comparative Example 1 and 2 was subjected to an adhesive treatment in which an epoxy resin component was applied to the composite yarn in a first treatment bath and then an RFL component was applied to the composite yarn in a second treatment bath. The total amount of the applied resin components was about 2.5% by mass.

Then, specimens of each of the resultant adhesive-treated cords were embedded parallel to each other in a central portion of a NR/SBR rubber plate having a thickness of 4 mm with intervals of 7 mm, and the resultant reinforced rubber plate was cut at a width of 7 mm in parallel to the longitudinal direction of the embedded cord specimens, into slit pieces.

With respect to bonding strength of the reinforcing yarns to the rubber matrix in each slit piece, a drawing strength of the cords from the rubber matrix and a peeling strength of the cords from the rubber matrix at right angles to the longitudinal direction of the cords in the rubber plate were measured. The results are shown in Table 2.

TABLE 2

| | Example No. | | |
|---|---|---|---|
| | Example | Comparative Example | |
| Item | 1 | 1 | 2 |
| Thickness of composite yarn (dtex) | 843 | 862 | 872 |
| Treatment of cord | | | |
| First treatment bath | Epoxy resin | Epoxy resin | Epoxy resin |
| Second treatment bath | RFL | RFL | FRL |
| Amount of applied adhesive (mass %) | 2.49 | 2.47 | 2.51 |
| Bonding property of composite yarn | | | |
| Drawing strength (N/7 mm) | 181 | 152 | 113 |
| Peeling strength (N/cord) | 11 | 10 | 6 |

INDUSTRIAL APPLICABILITY

In the reinforcing composite yarn of the present invention, a substantially non-twisted multifilament yarn and a substantially non-twisted staple fiber yarn are paralleled to each other without twisting, and a portion of the staple fibers in the staple fiber yarn are wound around the periphery of the composite yarn to firmly bind the multifilament yarn and the staple fiber yarn therewith, and thus the strength contributions, in the tensile strength, of the multifilament yarn and the staple fiber yarn on the composite yarn are high. Also, a portion of the staple fibers forms fluffs around the periphery of the composite yarn, and thus the fluffs exhibit a high anchoring effect for the composite yarn in the matrix material to be reinforced. Thus the reinforcing effect of the composite yarn for the matrix material is further enhanced. Accordingly, the reinforcing composite yarn of the present invention exhibits a high reinforcing effect on the matrix material (for example, resin or rubber material) to be reinforced and thus is useful in practice.

The invention claimed is:

1. A reinforcing composite yarn consisting essentially of a substantially non-twisted composite yarn comprising at least one substantially non-twisted multifilament yarn comprising a plurality of continuous filaments and paralleled with at least one substantially non-twisted staple fiber yarn comprising a plurality of staple fibers, wherein the continuous filaments in the multifilaments yarn are selected from poly-paraphenylene terephthalamide filaments, copolyparaphenylene-3,4'- oxydiphenylene-terephthalamide filaments, polyparaphenylene benzooxazole filaments, high strength polyethylene filaments, high strength polyvinyl alcohol filaments, wholly aromatic polyester filaments and carbon filaments;

the multifilament yam exhibits a tensile strength of 13 cN/dtex or more and an initial modulus of 300 cN/dtex or more;

the staple fibers in the staple fiber yarn are selected from nylon 6 staple fibers, nylon 66 staple fibers, meta-aromatic polyamide staple fibers, and para-aromatic polyamide staple fibers;

the staple fiber yarn comprises a staple fiber fraction having a fiber length of 1.5 times or more the average fiber length of the staple fiber yarn and another staple fiber fraction having a fiber length of 0.5 times or less the average fiber length of the staple fiber yarn, each in a content of at least 15% by mass; and a portion of the staple fibers in the staple fiber yarn is present in the form of winding around the periphery of the paralleled composite yarns, to thereby bind the multifilament yarn with the staple fiber yarns into a composite yarn.

2. The reinforcing composite yarn as claimed in claim 1, wherein the staple fibers in the staple fiber yarn have a individual fiber thickness of 5.5 dtex or less.

3. The reinforcing composite yarn as claimed in claim 1, having a tensile strength of 11.5 cN/dtex or more.

4. The reinforcing composite yarn as claimed in claim 1, wherein the multifilament yarn has a thickness in the range corresponding to 10 to 90% of the total thickness of the composite yarn.

5. The reinforcing composite yarn as claimed in claim 1, wherein the continuous filaments in the multifilament yarn have an individual filament thickness of 0.1 to 22 dtex.

6. The reinforcing composite yarn as claimed in claim 1, wherein the staple fibers in the staple fiber yarn have an average fiber length in the range of 35 to 150 cm.

7. The reinforcing composite yarn as claimed in claim 1, wherein a major portion of the individual continuous filaments is distributed in a core section of the composite yarn.

8. The reinforcing composite yarn as claimed in claim 1, wherein at least a portion of the individual continuous filaments and at least a portion of the individual staple fibers are intertwined with each other.

9. A process for producing a reinforcing composite yarn comprising:

paralleling at least one substantially non-twisted multifilament yarn comprising a plurality of continuous filaments selected from poly-paraphenylene terephthalamide filaments, copolyparaphenylene-3,4'-oxydiphenyleneterephthalamide filaments, polyparaphenylene benzooxazole filaments, high strength polyethylene filaments, high strength polyvinyl alcohol filaments, wholly aromatic polyester filaments and carbon filaments, and at least one substantially non-twisted staple fiber yarn comprising a plurality of staple fibers selected from nylon 6 staple fibers, nylon 66 staple fibers, meta-aromatic polyamide staple fibers, and a para-aromatic polyamide staple fibers, the multifilament yarn having a tensile strength of 13 cN/dtex or more and an initial modulus of 300 cN/dtex or more, and the staple fiber yarn containing at least 15% by mass of a staple fiber fraction having a fiber length of 1.5 times or more the average fiber length of the staple fiber yarn and at least 15% by mass of another staple fiber fraction having a fiber length of 0.5 times or less the average fiber length of the staple fiber yarn without twisting the paralleled yarns together; and passing the non-twisted paralleled composite yarn through an air eddy swirling along a plane intersecting the longitudinal axis direction of the paralleled composite yam, to thereby cause a portion of the staple fibers in the paralleled composite yarn to be wound around the periphery of the paralleled composite yarn to thereby bind the paralleled composite yarn therewith.

10. The process for producing a reinforcing composite yarn as claimed in claim 9, wherein the staple fibers in the staple fiber yarn have an individual fiber thickness of 5.5 dtex or less.

11. The process for producing a reinforcing composite yarn as claimed in claim 9, wherein the composite yarn has a tensile strength of 11.5 cN/dtex or more.

12. The process for producing a reinforcing composite yarn as claimed in claim 9, wherein the multifilament yarn has a thickness in the range corresponding to 10 to 90% of the total thickness of the composite yarn.

13. The process for producing a reinforcing composite yarn as claimed in claim 9, wherein the continuous filaments in the multifilament yarn have an individual filament thickness of 0.1 to 22 dtex.

14. The process for producing a reinforcing composite yarn as claimed in claim 9, wherein the staple fibers in the staple fiber yarn have an average fiber length in the range of 35 to 150 cm.

15. The process for producing a reinforcing composite yarn as claimed in claim 9, wherein the air eddy swirling procedure causes a major portion of the individual continuous filaments to be distributed in a core section of the composite yarn.

16. The process for producing a reinforcing composite yarn as claimed in claim 9, wherein the air eddy swirling procedure causes at least a portion of the individual continuous filaments and at least a portion of the individual staple fibers to be intertwined with each other.

* * * * *